US008128372B2

(12) United States Patent
Best

(10) Patent No.: US 8,128,372 B2
(45) Date of Patent: Mar. 6, 2012

(54) VENTILATOR WHEEL

(75) Inventor: Dieter Best, Ingelfingen (DE)

(73) Assignee: EBM-Papst Mulfingen GmbH & Co. KG, Mulfingen (DE)

( * ) Notice: Subject to any disclaimer, the term of this patent is extended or adjusted under 35 U.S.C. 154(b) by 547 days.

(21) Appl. No.: 12/375,807

(22) PCT Filed: Aug. 1, 2007

(86) PCT No.: PCT/EP2007/057981

§ 371 (c)(1),
(2), (4) Date: Jan. 30, 2009

(87) PCT Pub. No.: WO2008/015245

PCT Pub. Date: Feb. 7, 2008

(65) Prior Publication Data

US 2010/0003140 A1 Jan. 7, 2010

(30) Foreign Application Priority Data

Aug. 3, 2006 (DE) ..... 20 2006 011 899 U

(51) Int. Cl.
*B64C 11/04* (2006.01)
*F04D 29/36* (2006.01)

(52) U.S. Cl. ..... 416/219 R; 416/207

(58) Field of Classification Search ..... 416/204 R, 416/219 R, 241 R, 178, 210 R, 207
See application file for complete search history.

(56) References Cited

U.S. PATENT DOCUMENTS

| | | | | |
|---|---|---|---|---|
| 6,692,233 | B2 * | 2/2004 | Liang | 416/221 |
| 2003/0231960 | A1 | 12/2003 | Asada et al. | |
| 2005/0287005 | A1 * | 12/2005 | Gruber et al. | 416/244 R |

FOREIGN PATENT DOCUMENTS

| | | |
|---|---|---|
| DE | 602 960 | 9/1934 |
| DE | 39 41 691 | 7/1990 |
| EP | 1 571 345 | 9/2005 |

* cited by examiner

*Primary Examiner* — Thomas L Dickey
*Assistant Examiner* — Nikolay Yushin
(74) *Attorney, Agent, or Firm* — Brink Hofer Gilson & Lione

(57) ABSTRACT

The present invention relates to a ventilator wheel comprised of a hollow-cylindrical hub with fastening flanges disposed at the circumference for the detachable mounting of ventilator blades. The hollow-cylindrical hub and fastening flanges are made of steel. The fastening flanges may be connected to the hub via welding or another suitable means.

11 Claims, 4 Drawing Sheets

VENTILATOR WHEEL

CROSS REFERENCE TO RELATED APPLICATION

This application claims priority to PCT/EP2007/057981 filed Aug. 1, 2007 and DE 20 2006 011 899.3 filed Aug. 3, 2006, the entire contents of which are incorporated herein by reference.

FIELD

The present invention relates to a ventilator wheel comprising a hollow cylindrical hub with fastening flanges disposed at the circumference for the detachable fastening of ventilator blades.

BACKGROUND

A ventilator wheel as described in German Patent Specification No. DE 39 41 691 C2 (1991) fastening flanges cast directly onto the hub which at the same time forms the rotor of a drive motor embodied as an external rotor motor. The blades of the ventilator wheel are screwed onto these fastening flanges. The manufacturing of this ventilator wheel requires the production of expensive casting tools when the ventilator wheels have a mutually differing number of blades or position of the blades.

SUMMARY

The present invention is based on the objective of improving upon a known ventilator wheel, in such a way that production with any desired number and position of blades is possible without expensive special tools, so that broad production variation is attained at low manufacturing costs. According to one embodiment of the present invention, this may be achieved when the hollow cylindrical hub is made of steel and the fastening flanges are made of steel and connected to the hub by welding. In contrast to extensive metal blades, the fastening flanges made according to the teachings of the present invention can be welded on without difficulty. The reason for this is that these fastening flanges have a relatively low mass and are embodied in a compact manner. Conventional ventilator blades suffer from the problem of precise adjustment during the welding process, as well as from a warpage problem owing to the welding heat. In addition, warpage problems are further enhanced during the production of conventional ventilator blades because the marked removal of heat that takes place during welding over a large blade surface necessitates the use of high welding temperatures.

A ventilator wheel according to one aspect of the present invention is advantageously driven by a DC motor having a bell-shaped rotor. The bell-shaped rotor forms in accordance with the teachings of the present invention the hub of the ventilator wheel. Advantageously, the sheet steel fastening flanges are embodied as shaped parts, so that large-scale production of the fastening flanges is possible by punching and bending. However, manufacturing the fastening flanges by a laser cutting method is also possible.

Another aspect of the present invention provides the advantage that the wall thickness of the fastening flanges is greater, at least in the region of their abutment portion, than that of the wheel blades to be fastened. This allows the strength to be significantly increased compared to conventional possibilities for fastening.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The invention will be described in greater detail with reference to the exemplary embodiments illustrated in the appended drawings. The drawings described herein are for illustration purposes only and are not intended to limit the scope of the present disclosure in any way.

DETAILED DESCRIPTION

Figure 1:
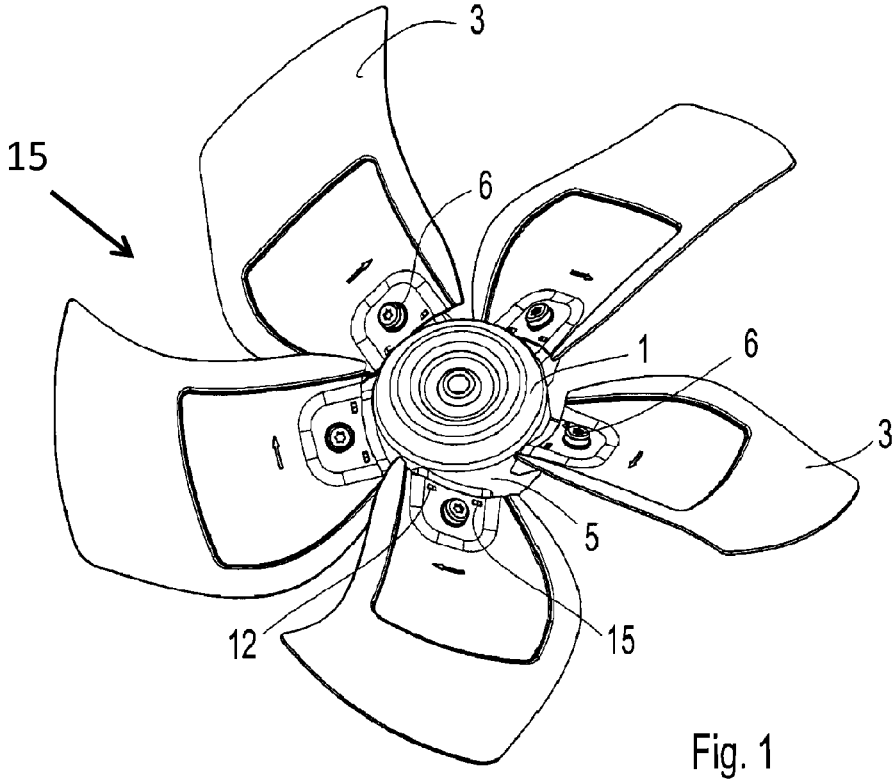
FIG. 1 is a front perspective view of a ventilator wheel assembly according to the teachings of the present invention.

The following description is merely exemplary in nature and is in no way intended to limit the present invention or its application or uses. It should be understood that throughout the description and drawings, corresponding reference numerals indicate like or corresponding parts and features.

Figure 2:
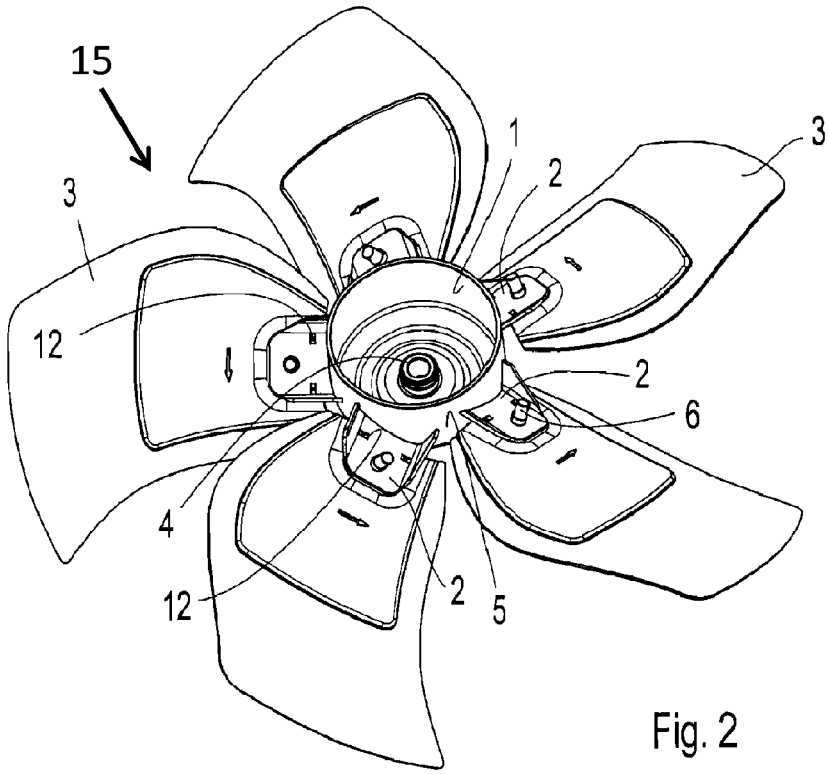
FIG. 2 is a rear perspective view of the ventilator wheel assembly according to FIG. 1.

Referring to FIG. 1 and FIG. 2, a ventilator wheel according to one embodiment of the present invention comprises a hollow cylindrical hub 1, to the circumference of which fastening flanges 2 are fastened. Ventilator blades 3 are in turn fastened to these fastening flanges 2. The hub 1 may be comprised of a hollow cylindrical bell which is closed on one side and which has in its interior on the end face, a hollow cylindrical rotor sleeve 4 for receiving the rotor shaft. The hub 1 is made of steel and can form the rotor of a DC motor.

On the outside of its wall 5, the hub has a large number of fastening flanges 2 (see in particular FIG. 2). In the example shown in FIG. 2, five fastening flanges 2 are arranged substantially equidistantly over the circumference and the rotor blades 3 are screwed onto these fastening flanges 2 by means of a fastening screw 6. According to one aspect of the present invention, the fastening flanges 2 are made of steel or steel sheet. This allows for a simple and inexpensive means to manufacture the fastening flanges 2. The fastening flanges 2 may be welded onto the hub 1 over the circumference. The fastening flanges 2 can also expediently be manufactured as punched parts or punched bent parts, as well as cutting them out using a laser cutting method. The fastening flanges 2 are embodied in a relatively compact manner, wherein the thickness of the fastening flanges 2 can be greater than the thickness of the ventilator blades 3 to be fastened.

The welding method applied for welding the fastening flanges 2 onto the hub 1 can be any welding method, including but not limited to Metal Arc, laser, or laser with additional material. The dimensions of a ventilator wheel according to the invention may be for example 200 mm (diameter of the hub 1) and for example 800 mm (diameter of the ventilator wheel as a whole). Owing to the configuration according to various aspects of the present invention, the size and orientation of the blades 3 can be varied in any desired manner. The present invention is advantageous in that the number of blades or the fastening height can to be varied much more simply.

Figure 3:
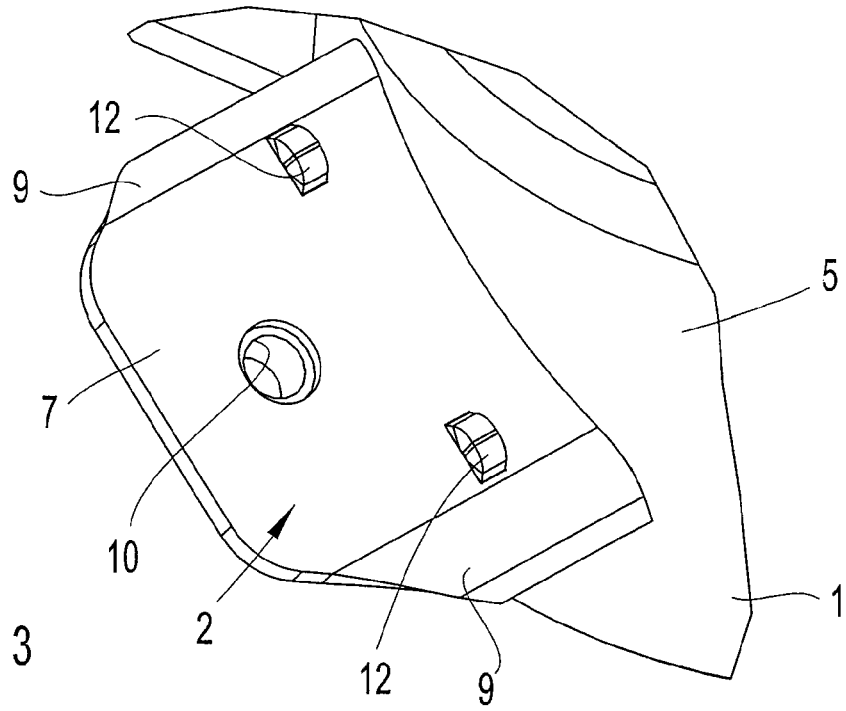
FIG. 3 is a front perspective view of a fastening flange according to the teachings of the present invention.
Figure 4:
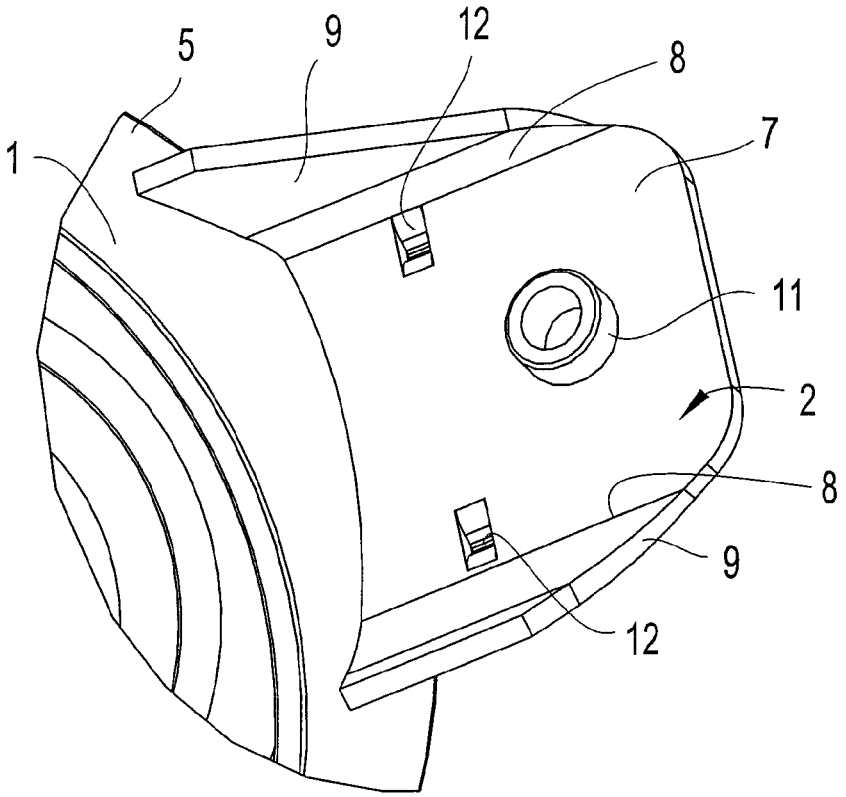
FIG. 4 is a rear perspective view of the fastening flange according to FIG. 3.

Referring now to FIGS. 3 and 4, a fastening flange 2 according to one aspect of the present invention comprises a sheet steel punched bent part. This punched bent part may further comprise a central abutment portion 7 having stiffening webs 9 which are each bent over at the longitudinal sides 8 of said abutment portion. The stiffening webs 9 may have a substantially triangular shape; the stiffening webs 9 being tapered toward the free end of the abutment portions 7. This produces an embodiment, which is U-shaped in cross section, of the fastening flanges 2 where the fastening flanges are welded onto the hub 1, preferably in the lower fastening region.

The fastening flanges 2 may be arranged at the circumference of the hub 1 in such a way that the fastening flanges 2 protrude radially and run on the hub wall 5 obliquely from the front to the back of the hub 1. The size and orientation of the fastening flanges 2 can be varied as desired in accordance with the respective requirements of the individual ventilator wheel. As both the hub 1 and the fastening flanges 2 are made of steel, simple welding of the two parts is possible using conventional welding methods. The ventilator blades 3 are fastened to the fastening flanges 2 in the region of their abutment portions 7 on the abutment side pointing in the direction of the front of the hub 1. This fastening is carried out by means of the fastening screw 6. This screw 6 is for this purpose screwed into an internal threaded opening 10 in the respective fastening flange 2.

As may be seen from FIG. 4, the threaded opening 10 is formed by a hollow cylindrical attachment 11 pointing in the direction of the back. In order to orient the ventilator blades 3 on the fastening flanges 2, the fastening flanges have attachments 12 that are arranged offset relative to the threaded opening 10 in the direction toward the hub 1, protrude from the abutment surface of the abutment portion 7, and have a rounded circumferential contour. These attachments 12 are used to orient the ventilator blades 3, for which reason said ventilator blades have in their base region corresponding recesses 15, such as is shown in FIGS. 1 and 2. These attachments 12 are arranged with play in the recesses 15.

Figure 5:
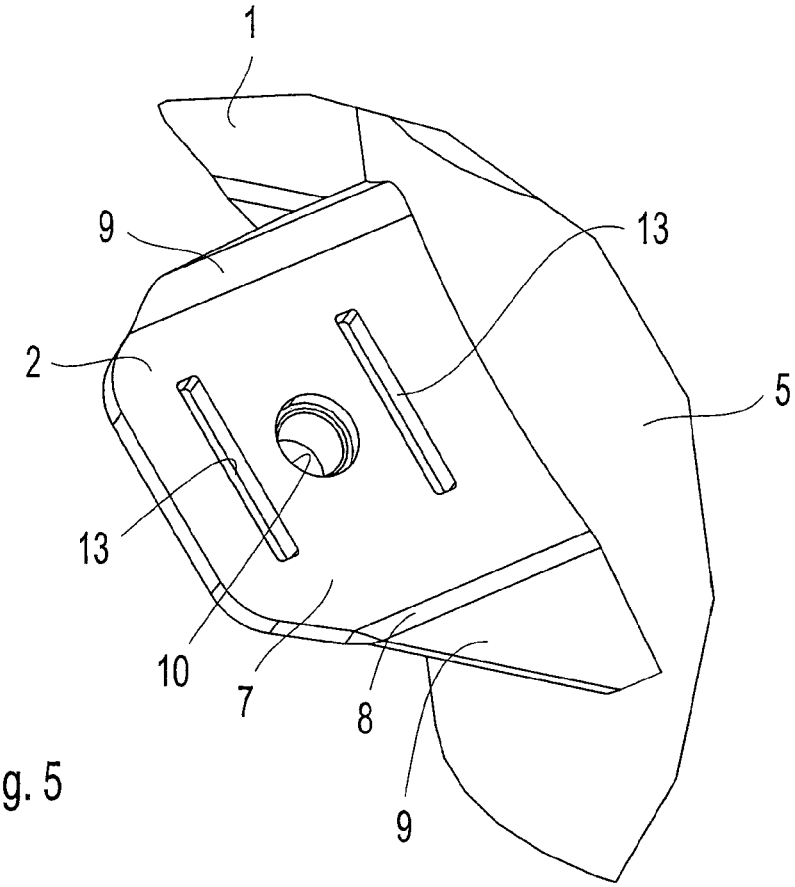
FIG. 5 is a front perspective view of an alternative embodiment of a fastening flange according to the teachings of the present invention.
Figure 6:
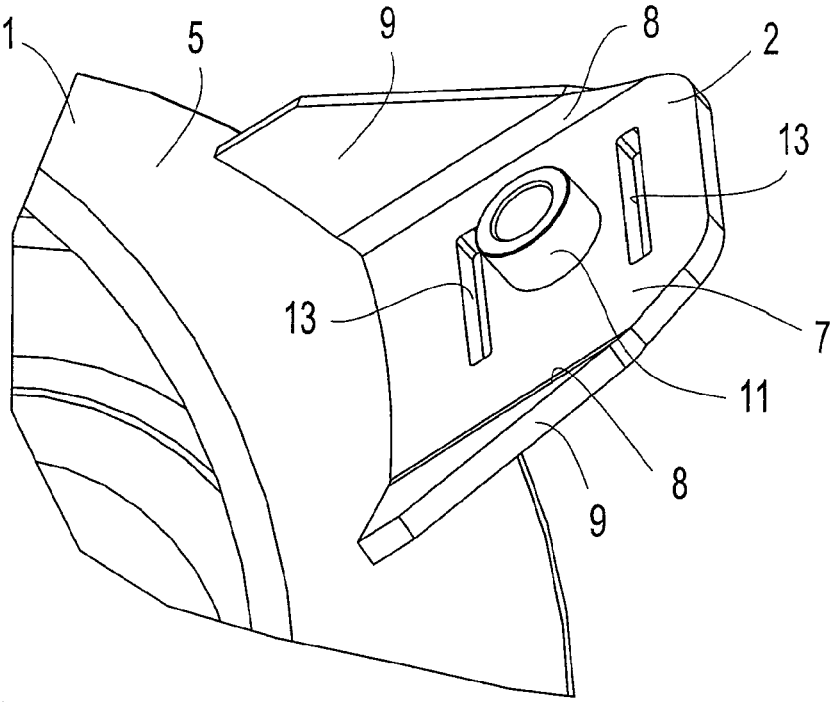
FIG. 6 is a rear perspective view of the fastening flange according to FIG. 5.
Figure 7:
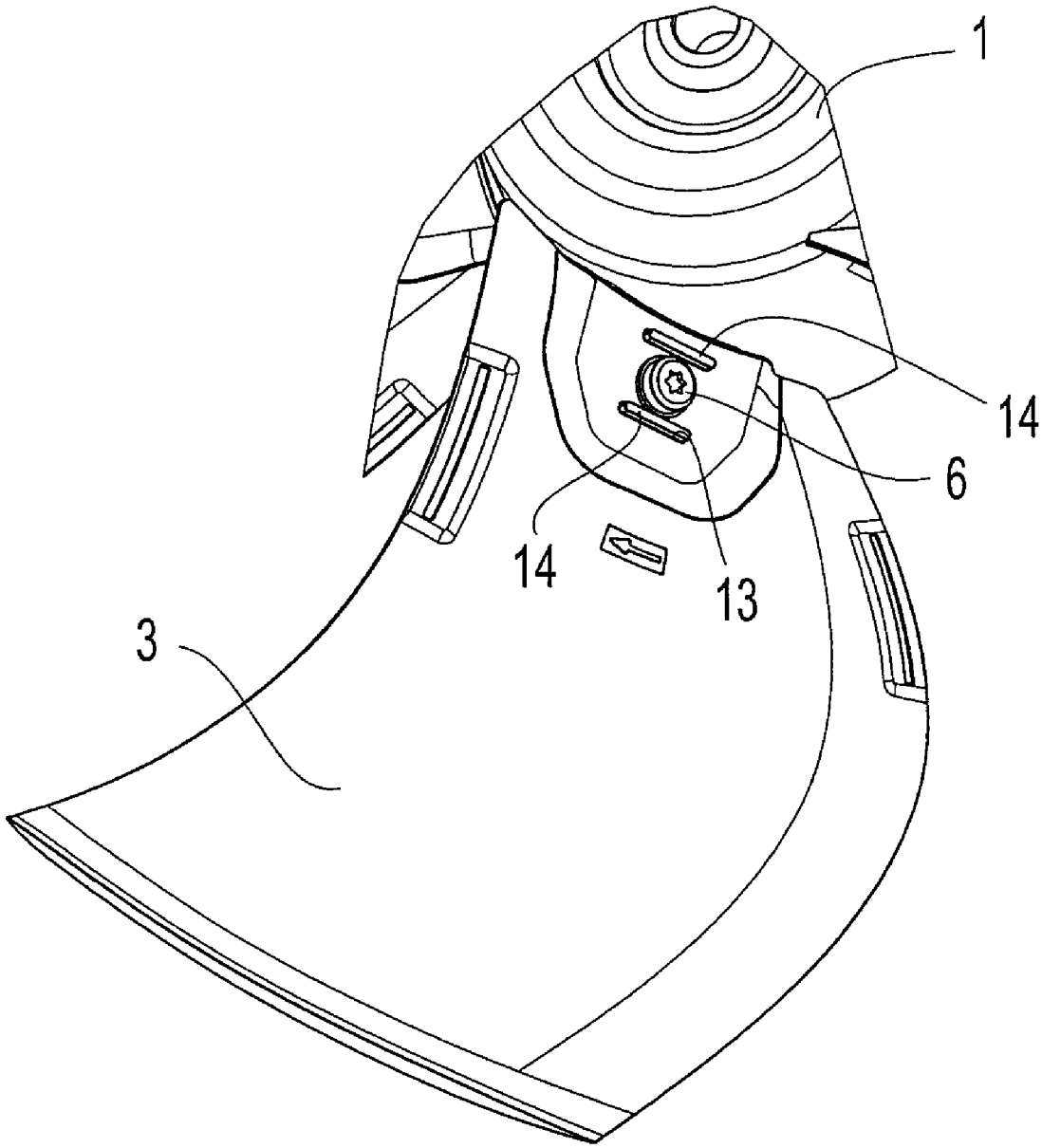
FIG. 7 is a more detailed perspective view of a ventilator wheel according to the teachings of the present invention consistent with the embodiment shown in FIGS. 5 and 6.

Another aspect of the present invention is illustrated in FIGS. 5, 6 and 7. In this example, slots 13, which each run parallel to each other and into which correspondingly adapted web attachments 14 on the blades 3 protrude, are formed above and below the threaded opening 10. These web attachments 14 are arranged in the corresponding slots 13 in the fastening flanges 2 with at least some circumferential play. This allows the ventilator blades 3 to be positioned with some degree of precision on the fastening flanges 2. The web attachments 14 are each, on both sides of the ventilator blades 3, formed by the ventilator blades. The blades 3 can be rotated through 180° if a different direction of conveyance of the ventilator is desired.

The configuration according to one aspect of the present invention allows ventilator blades 3, which can be made of a broad range of materials, including but not limited to metal or plastics material, to be fastened to the fastening flanges 2. Die cast blades 3 or blades 3 punched from a corresponding metal material can also be used and fastened using the same type of fastening.

Another objective of the present is to provide a ventilator wheel assembly 15 that comprises a plurality of ventilator blades 3; a hollow cylindrical hub 1; and a plurality of fastening flanges 2 disposed at the circumference of the hollow cylindrical hub 1 for the detachable fastening of the ventilator blades 3. The hollow cylindrical hub 1 and fastening flanges 2 may be made of steel with the fastening flanges 2 being connected to the hub 1 by welding. The invention also allows blades 3 of relatively large motors to be constructed, in the case of slowly rotating axial fans, as well as on motors having a relatively small diameter, as the same type of fastening can be provided irrespective of the size of the blade.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A ventilator wheel used for fastening to ventilator blades, the ventilator wheel comprising:

a hollow cylindrical hub; and fastening flanges disposed on the outside circumference of the hollow cylindrical hub for the detachable fastening of the ventilator blades; the fastening flanges configured to be shaped or shaped bent parts;

wherein the hollow cylindrical hub is made of steel and the fastening flanges are made of steel and connected to the hub by welding.

2. The ventilator wheel as claimed in claim 1, wherein the wall thickness of the fastening flanges is greater, at least in the region of the region of abutment with the hub, than the thickness of the ventilator blades.

3. The ventilator wheel as claimed in claim 1, wherein the fastening flanges comprise a flat abutment portion and stiffening webs which are bent at the two opposing longitudinal sides of the abutment portion.

4. The ventilator wheel as claimed in claim 3, at least one internal threaded opening and also an aligning means for fastening the ventilator blades are embodied in the abutment portion.

5. The ventilator wheel as claimed in claim 4, further comprising a hollow cylindrical connection piece in which the internal threaded opening is formed.

6. A ventilator wheel assembly, the ventilator wheel assembly comprising:

a plurality of ventilator blades;

a hollow cylindrical hub; and a plurality of fastening flanges disposed on the outside circumference of the hollow cylindrical hub for the detachable fastening of the ventilator blades; the fastening flanges configured to be shaped or shaped bent parts;

wherein the hollow cylindrical hub is made of steel and the fastening flanges are made of steel and connected to the hub by welding.

7. The ventilator wheel assembly as claimed in claim 6, wherein the ventilator blades are made of metal, plastics material or cast material.

8. The ventilator wheel assembly as claimed in claim 6, wherein the fastening flanges comprise a flat abutment portion and stiffening webs which are bent down at the two opposing longitudinal sides of the abutment portion.

9. The ventilator wheel as claimed in claim 6, wherein the wall thickness of the fastening flanges is greater, at least in the region of the region of abutment with the hub, than the thickness of the ventilator blades.

10. The ventilator wheel assembly as claimed in claim 8, further comprising at least one internal threaded opening and an aligning means for fastening the ventilator blades are embodied in the abutment portion.

11. The ventilator wheel assembly as claimed in claim 10, further comprising a hollow cylindrical connection piece in which the internal threaded opening is formed.

* * * * *